US005274201A

United States Patent [19]

Steele

[11] Patent Number: 5,274,201

[45] Date of Patent: Dec. 28, 1993

[54] NOISE MUFFLER FOR AN AIR BLOWER

[75] Inventor: James R. Steele, Stillwater, Minn.

[73] Assignee: Dynamic Air, Inc., St. Paul, Minn.

[21] Appl. No.: 989,697

[22] Filed: Dec. 14, 1992

[51] Int. Cl.[5] ..... E04F 17/04

[52] U.S. Cl. ..... 181/224; 181/257; 181/265; 181/267

[58] Field of Search ..... 181/224, 225, 230, 251, 181/252, 256, 258, 265, 267, 270, 268, 275, 249, 255, 269

[56] References Cited

U.S. PATENT DOCUMENTS

| | | | |
|---|---|---|---|
| 2,828,830 | 4/1958 | Clark | 181/275 |
| 2,950,776 | 8/1960 | Stephens | 181/224 |
| 3,583,523 | 6/1971 | Williams et al. | 181/224 |
| 3,977,493 | 8/1976 | Richardson | 181/253 |
| 3,981,378 | 9/1976 | Potter | 181/230 |
| 4,236,597 | 12/1980 | Kiss et al. | 181/256 |
| 4,281,740 | 8/1981 | Weiss et al. | 181/250 |
| 4,420,063 | 12/1983 | Bohlmann et al. | 181/229 |
| 4,533,015 | 8/1985 | Kojima | 181/280 |
| 4,582,164 | 4/1986 | Schreiner | 181/224 |
| 4,786,299 | 11/1988 | DeMarco | 181/256 |
| 5,183,976 | 2/1993 | Plemons, Jr. | 181/264 |

*Primary Examiner*—Michael L. Gellner
*Assistant Examiner*—Eddie C. Lee
*Attorney, Agent, or Firm*—Jacobson and Johnson

[57] ABSTRACT

The noise generated by onrushing air which is produced by an air blower for use in conjunction with pneumatic conveying equipment is substantially reduced by directing the air flow through an enclosed housing from an air inlet opening to an air outlet opening mainly via hollow tubular members made of air pervious material shaped in a snake-like or serpentine fashion between the air inlet and the air outlet openings.

6 Claims, 3 Drawing Sheets

NOISE MUFFLER FOR AN AIR BLOWER

FIELD OF THE INVENTION

This invention is directed for use with equipment or machinery which utilizes or produces noise-generating relatively large volumes of fast moving gases (hereinafter "air"). Typically, for example, dense phase pneumatic conveying systems use air to convey materials, such as granular materials, through hollow conduits over relatively long distances. Usually these systems include other types of equipment such as industrial dust collectors for removing dust and debris in industrial plants or reducing the amount of dust from the materials being processed. The volume of air and the rate of flow are such that it can create bothersome if not harmful noise. The present invention is directed toward significantly abating or reducing the noise of the onrushing air.

Some prior art noise abaters are shown in U.S. Pat. Nos. 3,092,206 and 3,802,163 for use with internal combustion engines and U.S. Pat. Nos. 4,050,913 and 4,786,299 for use with industrial style vacuum cleaners. All of these devices utilize staggered baffles which block, deflect, and vary the direction of flow of the air to attenuate the sound and decrease the decibel level. Another prior art device is illustrated in U.S. Pat. No. 3,113,635 which is directed towards reducing vibrational noise generated by an automobile engine. This device appears to use hollow tubular elements of different lengths and/or sizes to provide different lengths for the air flow path so that phasing of the noises tend to cancel out one another.

SUMMARY OF THE INVENTION

The preferred form of the instant muffler is a rigid, completely enclosed housing which can be used, if necessary, as a stand or support for the air blower or fan and the motor which drives the blower. Preferably the housing is lined with an air pervious and sound absorbing material which may be, for example, panels of glass wool. The housing has an air inlet opening in one side, which will for descriptive purposes be referred to as the "top side" and an air outlet opening at an opposite side or the "bottom side." In the preferred form, linking the air inlet opening of the housing to the air outlet opening is a stack of hollow, tubular elements formed into a serpentine or a snake-like form within the confines of the housing to provide a circuitous path for the flow of air between the inlet and outlet openings. The tubular elements are made of an air pervious material. As a result, while a good deal of the air travels through the hollow bores of the tubular elements from the air inlet to the air outlet, also a good deal of the air passes through and around the walls of the tubular element in what probably is a some-what random fashion from the inlet to the outlet opening within the housing. The tubular elements may be stacked one on top of another and also may be placed directly or in contact alongside one another or separated by loosely placed spacers also made of air pervious material. The spacers are used to hold the stacks of tubular elements in place and since they are made of air pervious material, some air flows outside and around the tubular elements through the air spacers in traveling from the air inlet opening to the outlet opening in the housing.

DESCRIPTION OF THE PREFERRED EMBODIMENTS

Figure 1:
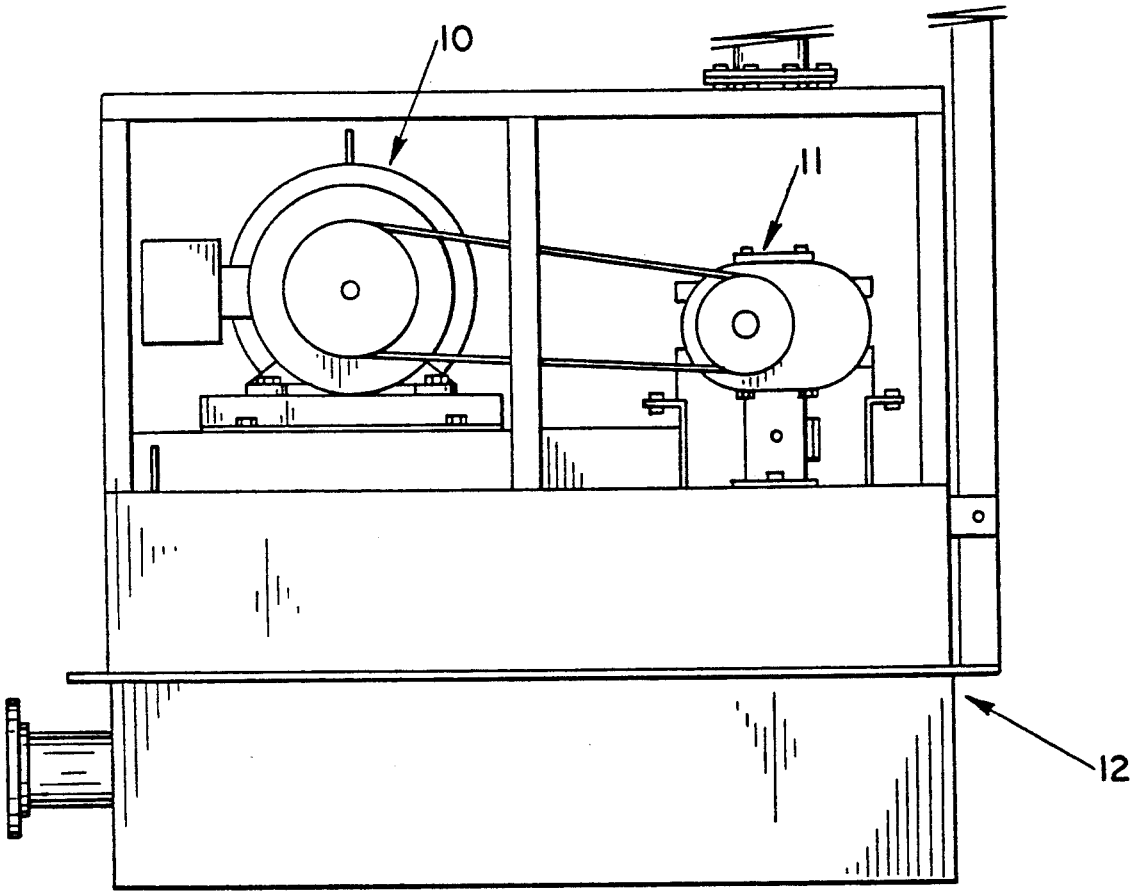
FIG. 1 is an elevational view illustrating an assembly of equipment with which the invention is used.

A system with which the present invention is utilized may comprise a suitable motor 10 coupled in conventional fashion through a belt and pulley arrangement to a fan or blower generally designated by reference numeral 11 with the latter in air communication with an air muffler, generally designated by reference numeral 12, through a suitable conventional conduit for providing moving air to some utilization device not shown, through conventional means, also not shown. In general the motor-blower combination is conveniently mounted on the housing of muffler 12 so for that reason the housing 13 of muffler 12 is made out of a rigid, weight-bearing metal such as plates of carbon steel. Housing 13 is a rectangular box having left and right side steel plates, front and back steel plates and top and bottom steel plates all welded together to make a totally enclosed housing 13. The interior of all sides of the housing has a layer 14 of some suitable sound absorbing material. Layer 14 is primarily to reduce vibration or noise from the vibration of the sides of housing 13 resulting from its attachment to motor 10 and blower 11. Lining the interior of layer 14 is a layer 15 of air-pervious, sound-absorbing or deadening material such as glass wool. Generally, lining 14 is attached to the interior of housing 13 by a suitable adhesive and panels of lining 15 may similarly be attached by adhesive to lining 14 or may rest in place unsecured.

Figure 2:
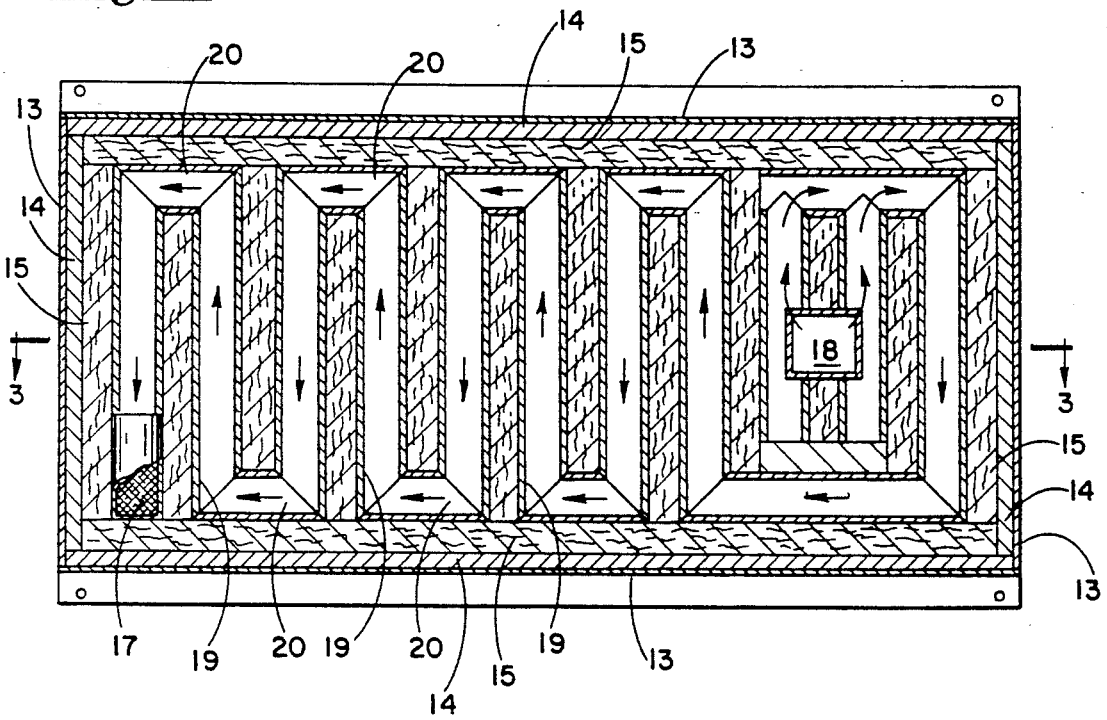
FIG. 2 is a horizontal section view of a preferred embodiment of the invention.
Figure 3:
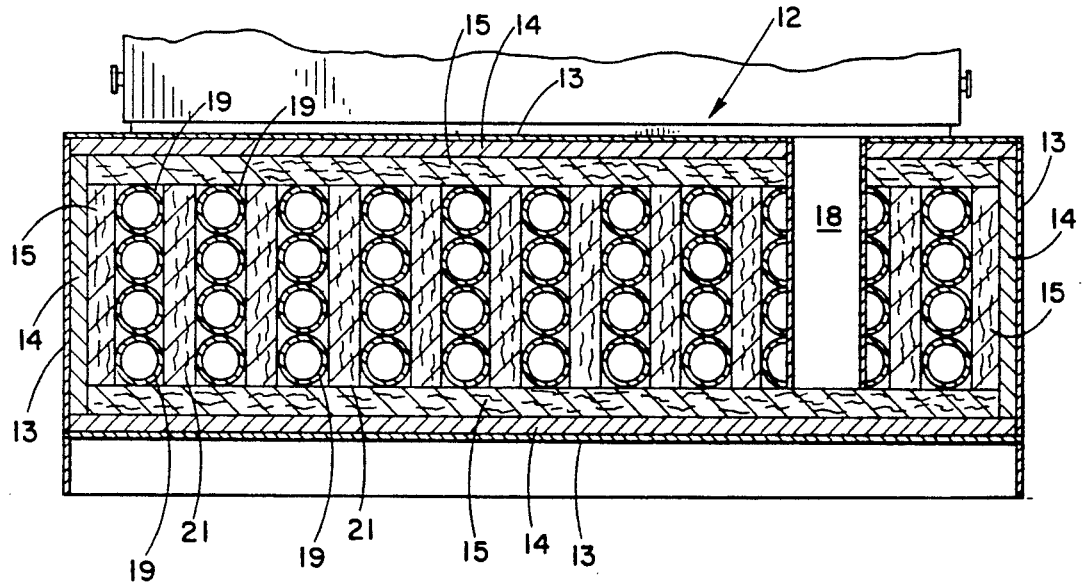
FIG. 3 is a vertical section view taken along line 3—3 of FIG. 2.

An opening 17 in the bottom plate of housing 13 provides an air outlet for housing 13. The opening 17 is conventionally covered by some suitable mesh screen to prevent rodents from crawling into the housing and/or to keep debris that might be carried by the air from falling onto the floor. Toward the other side, the right hand side as observed in FIGS. 2 and 3 is an air inlet opening 18 through the top plate of housing 13. As mentioned earlier, linking the outlet and the inlet openings are a set of tubular elements for carrying a good share of the air from the air inlet opening 18 to the outlet opening 17. The tubular elements are generally designated by reference numeral 19 and comprise basically a relatively stiff tubular element made out of an air pervious material such as glass wool. As illustrated in FIG. 2 the elements are laid out so that they end-to-end form a serpentine or snake-like path between the inlet and outlet openings of the housing. In the embodiment illustrated in FIG. 3 the tubular elements 19 are arranged in stacked layers of four elements resting one on top of the other. With reference to FIGS. 2 and 3 it can be observed that starting at the air outlet opening 17 each of the four stacked tubular elements 19 has one opening in air communication with air outlet opening 17 and then extends rearward. At its rearward opening each tubular element 19 is end-to-end with a short section of a similar tubular element, which for purposes of discussion will be identified by reference numeral 20. Elements 20 are mitered at each end to butt up against a similarly mitered end of elements 19. This arrangement continues through the interior of housing 13 from outlet opening 17 to inlet opening 18. The end-to-end contact of the various sections of the tubular elements 19 and 20 forms a continuous path for a good share of the air as it travels between the inlet and outlet openings. However, at the same time there is some substantial amount of air leakage or flow out of the tubular elements where the ends of the tubular elements somewhat loosely butt up against one another and also through the air pervious walls of the tubular elements. The seeping or leakage air travels in a somewhat random fashion between the air inlet and outlet openings of the housing.

As observed more clearly in FIG. 3 between stacks of tubular elements 19 are panels 21 which are also made of air pervious material such as glass wool. These spacers serve the purpose of keeping the tubular elements 19 and 20 in their stacked formation yet at the same time, since spacers 21 are made of an air pervious material, they allow air to pass through them to help in absorbing the sound of the moving air within housing 13.

Figure 5:
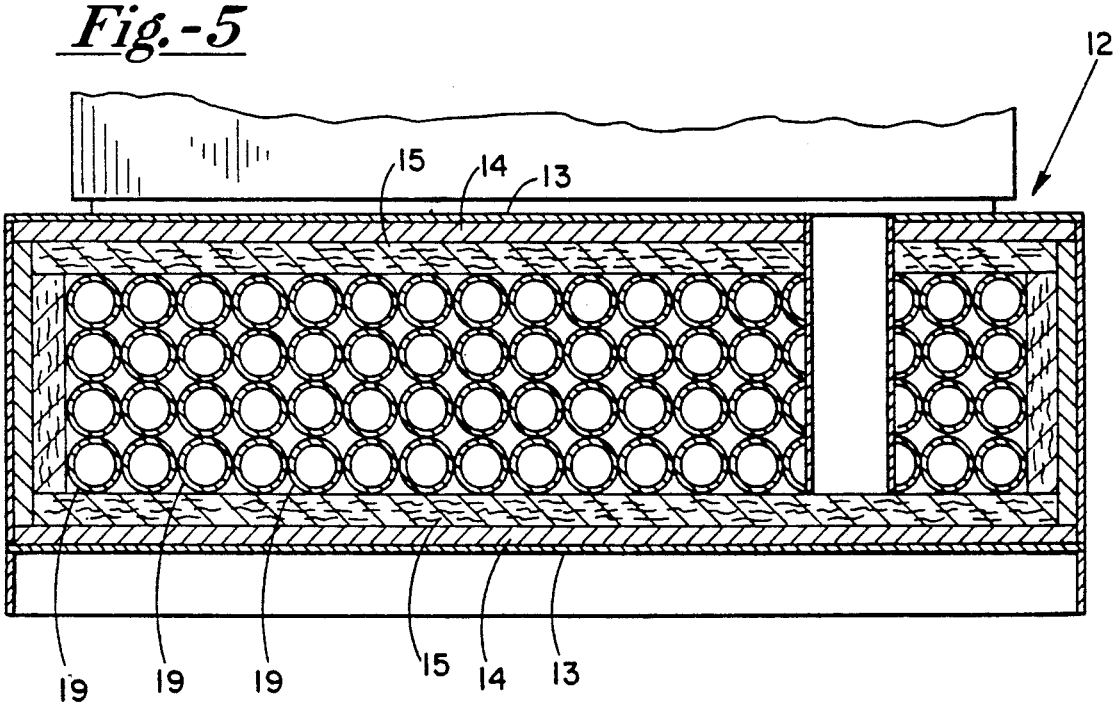
FIG. 5 is a vertical section view similar to FIG. 3 illustrating yet another embodiment of the invention.

FIG. 5 illustrates an embodiment that is very similar to that shown in FIGS. 2 and 3 except that spacers 21 are eliminated so that the tubular elements 19 and 20 of each layer in a stack rest against or alongside one-another as well as against the elements above and below. This provides a somewhat longer path for the air that flows through the tubular elements from the air inlet opening to the air outlet opening and in some cases provides a better muffling or deadening of the sound caused by the onrushing air. Also, in the embodiment illustrated in FIG. 5 lining 14 may be removed so that the interior of housing 13 is lined only with the sound absorbing layer 15.

Figure 4:
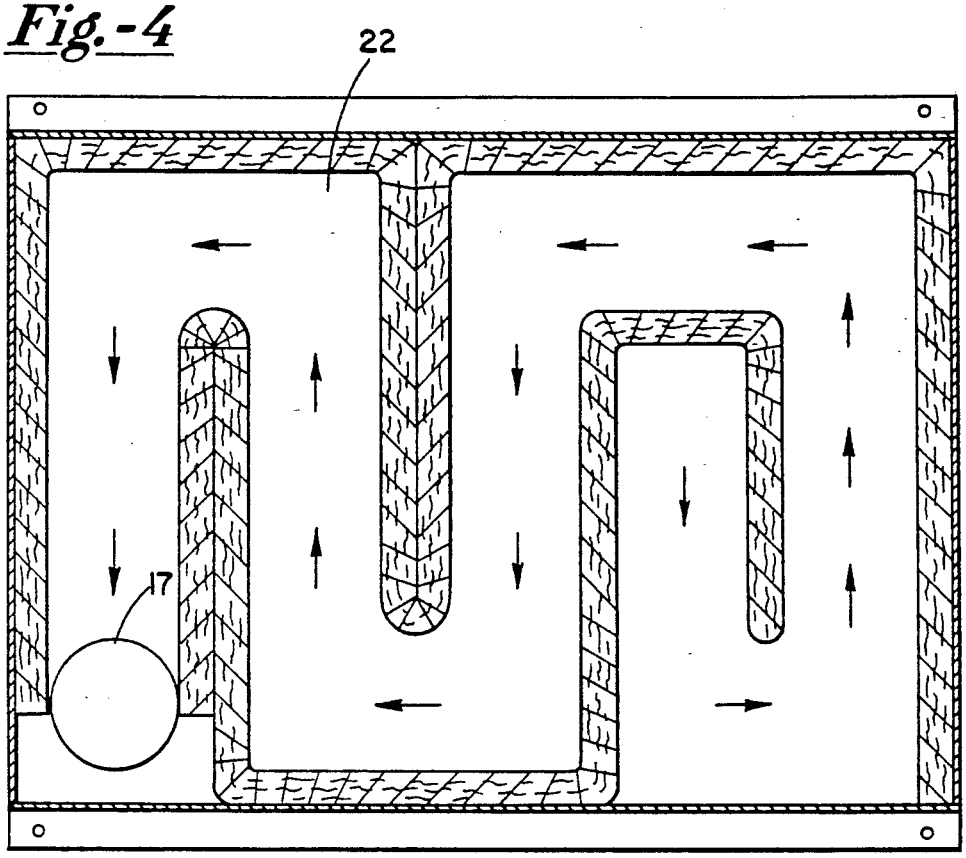
FIG. 4 is a horizontal section view of an alternate embodiment of the invention.

FIG. 4 is a horizontal section view of another embodiment of the invention. Here the tube which carries the air from the air inlet opening 18 to the outlet opening 17 is a single continuous tube 22 formed in a serpentine fashion between the two openings 17 and 18 in the inside of housing 13. In the FIG. 4 embodiment the tubular element preferably is formed out of glass wool so that it is also air pervious and sound absorbing but may not be as rigid as the tubular elements 19 and 20 of FIGS. 2 and 3. The FIG. 4 embodiment shows five, 180° bends in the connected tubular elements between the inlet and outlet openings but no limitation to there is intended.

I claim:

1. A noise muffler for an air blower comprising:

a) a rigid housing enclosing an uninterrupted chamber, said housing having an air inlet opening and an air outlet opening;

b) elongated hollow tubular conduit means made of air pervious material having an opening at each end;

c) said conduit means located in said chamber between said housing inlet opening and said housing outlet opening, one end opening of said conduit means in air communication with the housing air inlet opening and the other end opening of said conduit means in air communication with said housing air outlet opening;

d) air entering said air inlet opening traveling in part within said conduit means to the air outlet opening and in part exiting out of said conduit means through the air pervious material and traveling randomly to the air outlet opening within said chamber outside said conduit means.

2. The noise muffler as described in claim 1 wherein said conduit means compromises a continuous, serpentine, hollow tube.

3. The noise muffler as described in claim 1 wherein said conduit means comprises a plurality of separate hollow tubular members placed end to end arranged in a serpentine fashion between the housing air inlet opening and the housing air outlet opening.

4. The noise muffler as described in claim 1 wherein said conduit means comprises multiple tubular members stacked one on top of another.

5. The noise muffler as described in claim 4 wherein adjacent stacks of tubular members are separated by an air pervious spacer, air in part traveling outside said conduit means passing through said spacers

6. The noise muffler as described in claim 4 wherein said tubular members are also stacked alongside another.

* * * * *